United States Patent [19]

Beltzer et al.

[11] Patent Number: 5,034,141

[45] Date of Patent: Jul. 23, 1991

[54] LUBRICATING OIL CONTAINING A THIODIXANTHOGEN AND ZINC DIALKYLDITHIOPHOSPHATE

[75] Inventors: Morton Beltzer, Westfield, N.J.; Karla S. Colle, Houston, Tex.; Jacob J. Habeeb, Westfield, N.J.

[73] Assignee: Exxon Research and Engineering Company, Florham Park, N.J.

[21] Appl. No.: 404,035

[22] Filed: Sep. 7, 1989

[51] Int. Cl.[5] ..... C10M 135/14; C10M 137.06

[52] U.S. Cl. ..... 252/32.7 E; 252/45; 252/48.2

[58] Field of Search ..... 252/32.7 E, 33.6, 47

[56] References Cited

U.S. PATENT DOCUMENTS 2,410,650 11/1946 Giammaria ..... 252/33.6
2,694,682 11/1954 Harle ..... 252/47
4,293,430 10/1981 Rivier ..... 252/32.7 E

*Primary Examiner*—Prince E. Willis
*Assistant Examiner*—Ellen McAvoy
*Attorney, Agent, or Firm*—John W. Ditsler

[57] ABSTRACT

The addition of a thiodixanthogen and a metal thiophosphate to a lubricating oil results in an unexpected synergistic improvement in the antiwear performance of the oil. Octylthiodixanthogen and zinc dialkyldithiophosphate are most preferred additives.

14 Claims, No Drawings

LUBRICATING OIL CONTAINING A THIODIXANTHOGEN AND ZINC DIALKYLDITHIOPHOSPHATE

BACKGROUND OF THE INVENTION

1. Field of the Invention

This invention relates to a lubricating oil composition having improved antiwear performance due to the presence of a thiodixanthogen and a metal thiophosphate.

2. Description of Related Art

Engine lubricating oils require the presence of additives to protect the engine from wear. For almost forty years, the principal antiwear additive for engine lubricating oils has been zinc dialkyldithiophosphate (ZDDP). However, ZDDP must be used in concentrations of 1.4 wt. % or greater to be effective. Since phosphates may result in the deactivation of emission control catalysts used in automotive exhaust systems, a reduction in the amount of phosphorus-containing additives (such as ZDDP) in the oil would be desirable. In addition, ZDDP alone does not provide the enhanced antiwear protection necessary in oils used to lubricate today's small, high performance engines.

Thiodixanthogens have also been used in lubricating oil compositions (see, for example, U.S. Pat. Nos. 2,681,316; 2,691,632; 2,694,682; and 2,925,386; the disclosures of which are incorporated herein by reference.

However, none of these publications suggest that the antiwear performance of a lubricating oil can be synergistically enhanced when a thiodixanthogen and a metal thiophosphate are present therein.

SUMMARY OF THE INVENTION

This invention concerns a lubricating oil containing antiwear reducing amounts of certain dixanthogens and a metal thiophosphate. More specifically, we have discovered that the antiwear performance of a lubricating oil is synergistically enhanced when the oil contains a minor amount of a thiodixanthogen and a metal thiophosphate. Octylthiodixanthogen and zinc dialkyldithiophosphate are particularly preferred thiodixanthogens and metal thiophosphates, respectively.

DETAILED DESCRIPTION OF THE INVENTION

In one embodiment, this invention concerns a lubricating oil composition comprising (a) a lubricating oil basestock, (b) a thiodixanthogen, and (c) a metal thiophosphate In another embodiment, this invention concerns a method for reducing the wear of an internal combustion engine by lubricating the engine with an oil containing an oil soluble additive system comprising a thiodixanthogen and a metal thiophosphate.

In general, the lubricating oil will comprise a major amount of a lubricating oil basestock (or base oil) and a minor amount of an additive system which contains a thiodixanthogen and a metal thiophosphate. If desired, other conventional lubricating oil additives may be present in the oil as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40.° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins polybutylenes, polypropylenes, propylene-isobutylene copolymers, chlorinated polybutylenes, poly(l-hexenes), poly(l-octenes), poly(l-decenes), etc., and mixtures thereof); alkylbenzenes dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The thiodixanthogen used in this invention has the general formula

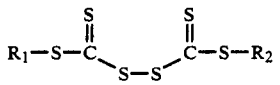

where $R_1$ and $R_2$ are each an alkyl group (straight, branched, or cyclic); an alkoxy substituted alkyl group; a polyalkoxy substituted alkyl group; an aryl group; or a substituted aryl group, Preferably $R_1$ and $R_2$ are each a straight alkyl group, a branched alkyl group, or an alkoxy substituted alkyl group. Most preferably, $R_1$ comprises a straight chained alkyl group. Typically, at least one of $R_1$ and $R_2$ (and preferably both) will have from 1 to 24, preferably from 2 to 12, and more preferably from 2 to 8, carbon atoms. Although most thiodixanthogens will be soluble in lubricating oil, $R_1$ and $R_2$ together should be selected to ensure that the thiodixanthogen is oil soluble. Examples of suitable substituted groups in $R_1$ and $R_2$ include alkyl, aryl, hydroxy, alkylthio, amido, amino, keto, ester groups, and the like.

Examples of the various thiodixanthogens that can be used in this invention are methylthiodixanthogen, ethylthiodixanthogen, propylthiodixanthogen, hexylthiodixanthogen, octylthiodixanthogen, methoxythiodixanthogen, ethoxythiodixanthogen, benzylthiodixanthogen, and the like, or mixtures thereof. Preferred thiodixanthogens are propylthiodixanthogen, hexylthiodixanthogen, octylthiodixanthogen, or mixtures thereof. Propylthiodixanthogen, octylthiodixanthogen, or their mixtures are particularly preferred, with octyldithiodixanthogen being most preferred.

The metal thiophosphates used in this invention preferably comprises a metal selected from the group consisting of Group IB, IIB, VIB, VIII of the Periodic Table, and mixtures thereof. A metal dithiophosphate is a preferred metal thiophosphate, with a metal dialkyldithiophosphate being particularly preferred. Copper, nickel, and zinc are particularly preferred metals, with zinc being most preferred. The alkyl groups preferably comprise from 3 to 10 carbon atoms. Particularly preferred metal thiophosphates are zinc dialkyldithiophosphates.

The amount of thiodixanthogen and metal thiophosphate used in this invention need be only that which is necessary to cause an enhancement in the antiwear performance of the oil. Typically, however, the concentration of the thiodixanthogen in the lubricating oil will range from about 0.01 to about 2.0 wt. %, preferably from about 0.03 to about 1.0 wt. %, and most preferably from about 0.04 to about 0.4 wt. %, of the lubricating oil. Similarly, the concentration of the metal thiophosphate will be within the same ranges as the thiodixanthogen.

Metal thiophosphates are commercially available from a number of vendors. As such, their method of manufacture is well known to those skilled in the art. Similarly, thiodixanthogens can be prepared by procedures known in the art and as shown in Example 1 below.

The additives (or additive system) of this invention can be added directly to the lubricating oil. Often, however, they can be made in the form of an additive concentrate to facilitate handling and introduction of the additives into the oil. Typically, the concentrate will contain a suitable organic diluent and from about 10 to about 90 wt. %, preferably from about 30 to about 80 wt. %, of the additives. Suitable organic diluents include mineral oil, naphtha, benzene, toluene, xylene, and the like. The diluent should be compatible (e.g. soluble) with the oil and, preferably, should be substantially inert.

The lubricating oil (or concentrate) may also contain other additives known in the art such that a fully formulated oil is formed. Such additives include dispersants, other antiwear agents, antioxidants, corrosion inhibitors, detergents, pour point depressants, extreme pressure additives, viscosity index improvers and the like. These additives are typically disclosed, for example, in "Lubricant Additives" by C. V. Smalheer and R. Kennedy Smith, 1967, pp. 1-11 and in U.S. Pat. No. 4,105,571, the disclosures of which are incorporated herein by reference. These additives are present in proportions known in the art.

A lubricating oil containing the additive system of this invention can be used in essentially any application where wear protection is required. Thus, as used herein, "lubricating oil" (or "lubricating oil composition") is meant to include automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples which are not intended to restrict the scope of the claims.

EXAMPLE 1

Preparation of Octylthiodixanthogen 438.9 g (520.6 ml, 3 moles) of 1-octanethiol were refluxed (with stirring) for about 1 hour with 66 g. (1 mole 85% purity) potassium hydroxide flakes. 72.5 ml (91.33 g., 1.2 moles) of $CS_2$ were then added (dropwise) with stirring to the mixture which had been cooled to 0° C. in an ice-water bath. The mixture was stirred for about 1 hour after addition was complete, and then allowed to warm to room temperature. The resulting white solid precipitate was filtered, thoroughly washed with anhydrous ethyl ether, and dried overnight in a vacuum oven at 35° C. 250.1 g. of potassium octylthioxanthate were obtained (96% yield).

260.55 g. (1 mole) of the potassium octylthioxanthate was dissolved in about 250 ml of deionized water and cooled to 0° C. 345.7 g. (1.05 moles) of potassium ferricyanide dissolved in deionized water was added (dropwise) with stirring. Stirring was continued for about 1 hour after addition was complete, and the solution allowed to warm to room temperature. The mixture was transferred to a separatory funnel and about 250 ml of anhydrous ethyl ether was added. The layers were separated and the water layer washed with another 100 ml of ether. The ether layers were combined and dried over anhydrous sodium sulfate. Ether was then stripped from the product, leaving octylthiodixanthogen as a dark golden oil (200 g., 90% yield).

Portions of this product were used to formulate some of the oil samples tested in Example 2.

EXAMPLE 2

Four Ball Wear Tests

Four Ball Wear tests were performed to determine the effectiveness of zinc dialkyldithiophosphate (ZDDP), octylthiodixanthogen (OTDIX), or their mixtures in reducing wear. The Four Ball test used is described in detail in ASTM method D-2266, the disclosure of which is incorporated herein by reference. In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 mm. Prior to the tests, the test cup, steel balls, and all holders were degreased with 1,1,1 trichlorethane. The steel balls subsequently were washed with a laboratory detergent to remove any solvent residue, rinsed with water, and dried under nitrogen.

The base lubricant utilized in all of these tests were 150 Neutral—a solvent extracted, dewaxed hydrofined neutral basestock having a viscosity of 32 centistokes (150 SSU) at 40° C. The Four Ball wear tests were performed at 100° C., 60 kg load, and 1200 rpm for 45 minutes duration.

After each test, the balls were degreased and the Wear Scar Diameter (WSD) on the lower balls measured using an optical microscope. Using the WSD's, the wear volume was calculated from standard equations (see Wear Control Handbook, edited by M. B. Peterson and W. O. Winer, p. 451, American Society of Mechanical Engineers [1980]). The percent wear reduction was then calculated. The results of these tests and calculations are shown in Table 1 below.

TABLE 1

| Additive, wt. % | | WSD, | Wear Volume, | % Wear |
|---|---|---|---|---|
| ZDDP | OTDIX | mm | $mm^3 \times 10^4$ | Reduction |
| — | — | 1.71 | 648 | 0 |
| — | 0.05 | 1.70 | 645 | 0 |
| — | 0.10 | 1.20 | 160 | 75 |
| — | 0.20 | 0.89 | 48 | 93 |
| 0.05 | — | 1.67 | 601 | 7 |
| 0.10 | — | 1.44 | 332 | 49 |
| 0.20 | — | 0.80 | 32 | 95 |
| 0.05 | 0.05 | 0.91 | 53 | 92 |
| 0.05 | 0.10 | 0.86 | 42 | 94 |

TABLE 1-continued

| Additive, wt. % | | WSD, | Wear Volume, | % Wear |
|---|---|---|---|---|
| ZDDP | OTDIX | mm | $mm^3 \times 10^4$ | Reduction |
| 0.20 | 0.10 | 0.80 | 32 | 95 |
| 0.20 | 0.20 | 0.78 | 29 | 96 |
| 0.20 | 0.50 | 0.82 | 35 | 95 |

The data in Table 1 show that the combination of a thiodixanthogen and a metal thiophosphate in a lubricating oil unexpectedly results in significantly less wear than when each compound is used alone at the same concentration levels. More specifically, at 0.05 wt. %, neither the metal thiophosphate or the thiodixanthogen, when present alone in the oil, results in any significant wear reduction. However, 92% wear reduction was obtained when both were used together at this low concentration.

What is claimed is:

1. A lubricating oil composition which comprises a major amount of a lubricating oil basestock and (a) from about 0.04 to about 0.4 wt. % of a thiodixanthogen having the formula

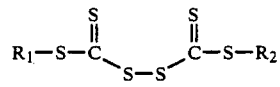

where $R_1$ and $R_2$ are each an alkyl group having from 2 to 8 carbon atoms, and (b) from about 0.04 to about 0.4 wt. % of zinc dialkyldithiophosphate, wherein the amounts of (a) and (b) are synergistically effective in improving the antiwear properties of the lubricating oil composition.

2. The composition of claim 1 wherein the thiodixanthogen comprises at least one member selected from the group consisting of propylthiodixanthogen, hexylthiodixanthogen, octylthiodixanthogen, and mixtures thereof.

3. The composition of claim 2 wherein the thiodixanthogen comprises at least one member selected from the group consisting of propylthiodixanthogen, octylthiodixanthogen, and mixtures thereof.

4. The composition of claim 3 wherein the thiodixanthiogen comprises octylthiodixanthogen.

5. A method for reducing the wear of an internal combustion engine which comprises lubricating the engine with the lubricating oil composition of claim 1.

6. The method of claim 5 wherein the thiodixanthogen comprises at least one member selected from the group consisting of propylthiodixanthogen, hexylthiodixanthogen, octylthiodixanthogen, and mixtures thereof.

7. The method of claim 6 wherein the thiodixanthogen comprises at least one member selected from the group consisting of propylthiodixanthogen, octylthiodixanthogen, and mixtures thereof.

8. The method of claim 7 wherein the thiodixanthogen comprises octylthiodixanthogen.

9. An additive concentrate suitable for blending with lubricating oils to provide a lubricating composition having improved antiwear performance which comprises an organic diluent and from about 10 to about 90 wt. % of an additive system containing (a) a thiodixanthogen having the formula

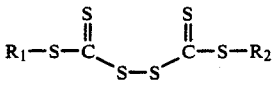

where $R_1$ and $R_2$ are each an alkyl group having from 2 to 8 carbon atoms, and (b) zinc dialkyldithiophosphate, wherein the amounts of (a) and (b) are synergistically effective in improving the antiwear properties of the lubricating oil composition.

10. The concentrate of claim 9 wherein the thiodixanthiogen comprises at least one member selected from the group consisting of propylthiodixanthogen, hexylthiodixanthogen, octylthiodixanthogen, and mixtures thereof.

11. The concentrate of claim 10 wherein the thiodixanthogen comprises at least one member selected from the group consisting of propylthiodixanthogen, octylthiodixanthogen, and mixtures thereof.

12. The concentrate of claim 11 wherein the thiodixanthogen comprises octylthiodixanthogen.

13. The concentrate of claim 9 wherein the organic diluent is mineral oil, naphtha, benzene, toluene, or xylene.

14. The concentrate of claim 13 wherein the organic diluent comprises a mineral oil in which the additive system is soluble.

* * * * *